US005139650A

United States Patent [19]

Lenglet

[11] Patent Number: 5,139,650

[45] Date of Patent: Aug. 18, 1992

[54] METHOD AND INSTALLATION FOR STEAM CRACKING HYDROCARBONS

[75] Inventor: Eric Lenglet, Marly Le Roi, France

[73] Assignee: Procedes Petroliers et Petrochimiques, Marly Le Roi, France

[21] Appl. No.: 646,637

[22] PCT Filed: Jun. 5, 1990

[86] PCT No.: PCT/FR90/00390

§ 371 Date: Feb. 4, 1991

§ 102(e) Date: Feb. 4, 1991

[87] PCT Pub. No.: WO90/15118

PCT Pub. Date: Dec. 13, 1990

[30] Foreign Application Priority Data

Jun. 5, 1989 [FR] France ..... 89 07378

[51] Int. Cl.[5] ..... C10G 9/14; C07C 4/02; F28D 21/00

[52] U.S. Cl. ..... 208/132; 208/48 Q; 585/650; 422/197; 422/198; 422/207

[58] Field of Search ..... 208/132, 48 Q; 585/648, 585/650; 422/196, 197, 198, 207

[56] References Cited

U.S. PATENT DOCUMENTS 3,607,153 9/1971 Cijer ..... 48/102 R 4,714,109 12/1987 Tsao ..... 165/104.18

FOREIGN PATENT DOCUMENTS 26674 4/1981 European Pat. Off. .

291408 11/1988 European Pat. Off. .

1348293 2/1963 France .

2197963 3/1974 France .

0557089 5/1977 Greece .

WO/87/050-43 8/1987 PCT Int'l Appl. .

OTHER PUBLICATIONS

Chemical Abstracts, vol. 87, No. 12, Dec. 19, 1977 "Processing of Hydrocarbon Raw Materials," Lobanov, V. A., p. 171.

*Primary Examiner*—Theodore Morris

*Assistant Examiner*—P. L. Hailey

*Attorney, Agent, or Firm*—Bell, Seltzer, Park & Gibson

[57] ABSTRACT

A method and apparatus for steam cracking hydrocarbons in a furnace (10) having rectilinear single-pass tubes (12) which are interconnected at their outlet ends by a manifold (18) within which the steam cracking effluents are subjected to limited pre-quenching by injection of a cooler gaseous medium, with the effluents then being conveyed to quenching means (22). The invention serves in particular to increase the yield of hydrocarbon steam cracking installations.

18 Claims, 6 Drawing Sheets

METHOD AND INSTALLATION FOR STEAM CRACKING HYDROCARBONS

Figure 1:
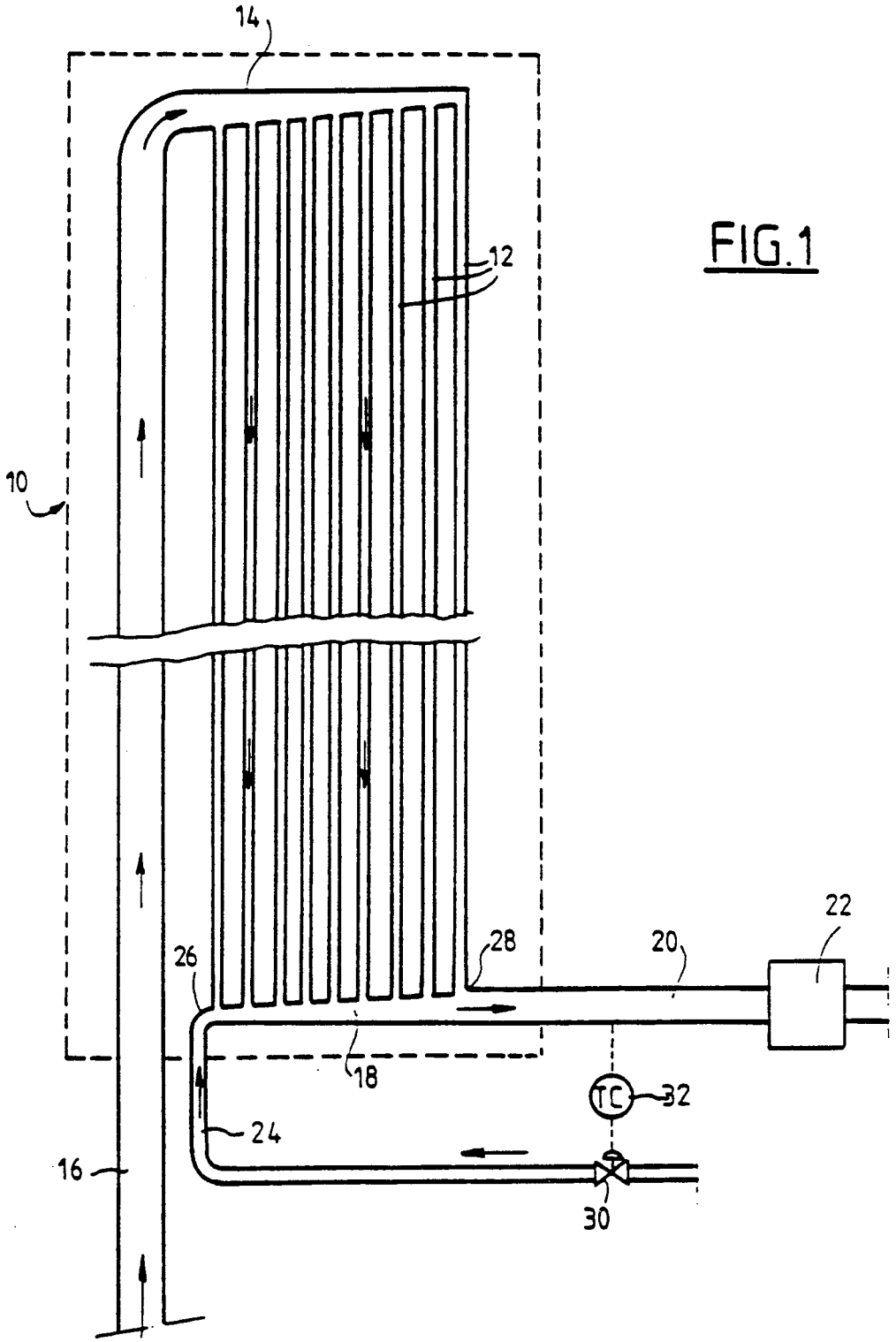

The invention relates to a method and to an installation for steam cracking hydrocarbons to produce ethylene and other unsaturated low hydrocarbons.

It is common practice to steam crack hydrocarbons in a furnace having tubes for circulating a steam-hydrocarbon mixture which is raised to high temperature, generally about 850° C. to 880° C., for a very short period of time, about 0.07 seconds (s) to 0.3 s.

Use is made, in particular, of furnaces in which the tubes form sinuous paths comprising a plurality of straight lengths in series. The tubes are connected via an outlet manifold to quenching means, either by direct contact with oil or else by indirect contact in a heat exchanger or in a boiler, with quenching being intended to stop chemical reactions in the steam cracking effluents, and in particular secondary pyrolysis reactions of the olefins formed by the steam cracking.

In these furnaces, the tubes are of great length and large diameter (e.g. an inside diameter of 75 mm to 150 mm), which prevents the effluents leaving the furnace having a high temperature (the rate of temperature rise in large-diameter tubes is insufficient, and obtaining high outlet temperatures for the effluents would lead to over cracking thereof). The time required for collecting and transferring the effluents to the quenching zone also makes it impossible to have a high effluent temperature at the outlet from the furnace since that would give rise to over cracking of the effluents and thus to a drop in yield.

However, there exists a hydrocarbon steam cracking method in which the reaction temperatures in the furnace and the temperatures of the effluents at the outlet from the furnace are very high (e.g. 880° C. to 900° C. for a feedstock of naphtha), and this is achieved by using a plurality of small-diameter tubes (e.g. 30 mm) with cracking being performed during a single pass through the furnace. In order to avoid effluent over cracking downstream from the tubes, the ends of the tubes are directly connected to a plurality of small quenching heat exchangers which are disposed on extensions of the furnace tubes, with each quenching heat exchanger corresponding to one of the furnace tubes or possibly to two of the furnace tubes. The hydrocarbons are thus cracked at very high temperature and they are quenched without significant transit time between the furnace and the quenching heat exchanger. Good yields of ethylene, propylene, and butadene are thus obtained. However, this technique requires special quenching heat exchangers to be implemented which are much less compact than the conventional quenching heat exchangers of the first technique mentioned above and which require a special decoking procedure which is rather difficult.

These two prior techniques cannot be combined since they are incompatible: merely replacing a quenching heat exchanger associated with a conventional furnace by a plurality of elementary heat exchangers situated on extensions of its tubes would not suffice, since this would require the tubes to pass through the roof of the furnace, and this cannot be done on existing furnaces. It is also impossible to replace the large-diameter tubes by a plurality of small tubes while retaining the quenching heat exchangers: in order to avoid over cracking in the transfer line going to the quenching heat exchangers, it would be necessary to limit the cracking temperatures which would loose the advantages related to using small tubes with a very high cracking temperature (ethylene yields increased by about 15%).

A particular object of the invention is to provide a method and apparatus for steam cracking hydrocarbons which enables the advantages of the two above-mentioned prior techniques to be combined without suffering from their drawbacks.

Another object of the invention is to provide a method and an installation for steam cracking hydrocarbons enabling a higher yield to be obtained in olefin production.

Another object of the invention is to provide a method and an installation of this type enabling a much wider range of hydrocarbon feedstocks to be treated using cracking of variable severity that can be determined at will.

The invention thus provides a method of steam cracking hydrocarbons to produce ethylene and other unsaturated low hydrocarbons, the method consisting in causing a feedstock of steam and hydrocarbons to pass at high speed through a furnace having single-pass small tubes and in subjecting the effluents to quenching on leaving the furnace, the method being characterized in that it consists in causing said tubes to open out into a collection zone situated inside the furnace and connected via a transfer duct to a quenching zone outside the furnace, and in performing controlled cooling of said effluents in a compact zone situated inside the furnace in the immediate proximity of the ends of the small tubes, thereby obtaining a considerable temperature drop within the collection zone, and performing limited pre-quenching of said effluents by not more than about 160° C., prior to their being transferred into their quenching zone.

This limited pre-quenching of the effluents prior to their leaving the cracking furnace makes it possible to work with higher temperatures and shorter transit times for the hydrocarbons in the furnace, thereby obtaining an improved yield of olefins, without thereby giving rise to over cracking in the transfer zone to the quenching heat exchanger. In addition, pre-quenching remains limited: this characteristic goes against the practice in the art (in conventional steam cracking procedures, efforts are made to quench the effluents completely by cooling by at least about 300° C. in order to freeze any subsequent chemical reaction, and this is not done in the present invention).

Because of the limited nature of the heat transfer in the invention, it is possible to perform the heat transfer in a zone which is very compact and installed inside the furnace. Once they have been cooled to a temperature of about 780° C. to 840° C., the effluents can be collected and transferred outside the furnace without significant over cracking. The invention thus makes it possible to transform an existing furnace by using small diameter single-pass tubes providing higher yields. It also becomes possible to use a single-pass furnace having small-diameter tubes without associating these tubes with elementary heat exchangers.

Finally, the invention makes it possible to avoid or limit post-cracking of the effluents between the furnace and the quenching zone.

In a first implementation of the invention, the limited cooling is performed in said compact zone by heat exchange with a fluid that is cooler than the steam cracking effluents. Advantageously, the heat exchanger used for this purpose is between 0.5 meters (m) and 1.2 m high and is located in the end zone of the small steam cracking tubes. The heat exchanger is advantageously thermally insulated (lagged) so as to avoid its being directly exposed to radiation from the furnace.

The cooling fluid may be water under high pressure, steam, compressed air (for use in a gas turbine), or a fraction of the steam cracking feedstock itself, without these examples being limiting.

In a second implementation of the invention, the limited cooling is performed by injecting into the collection zone a relatively low flow rate of a medium or an agent having a temperature which is lower than that of the steam cracking effluents.

Particularly advantageously, this flow rate may be injected substantially at the upstream end of the collection zone. In this way, the most intense cooling which is obtained at the beginning of the collection zone (cooling that is more intense than the final cooling after mixing with all of the collected effluents) makes it possible to completely eliminate any partial cracking at the beginning of the collection zone.

The medium or agent injected into the collection zone is preferably a gas.

It would be possible to inject a liquid into this zone to pre-quench the effluents, however there would then be a danger of creating cold spots in the collection zone, i.e. zones subjected to excess coking and to tar condensation.

According to another characteristic of the invention, the pre-quenching is determined so as to enable controlled post-cracking of the effluents to take place in the transfer duct and in the adjacent portion of the collection zone. It is easy to control the temperature of the effluent outlet from the collection zone by adjusting the flow rate or the temperature of the cooling fluid (regardless of whether cooling is obtained by indirect heat exchange or by injection and mixing).

The invention thus makes it possible to vary the temperature in the transfer line to the quenching heat exchanger, and optionally to provide controlled post-cracking in said zone. This can be done merely by cooling the effluents very little (or not at all). This disposition is particularly advantageous for light feedstocks such as propane or ethane which are relatively refractory and require longer transit times through the reaction zone.

The option of adjusting the severity of cracking by using an additional reaction zone is somewhat equivalent to having a furnace of variable geometry enabling transit time to be varied over a wide range (e.g. making it possible to increase it by 100%).

According to another characteristic of the invention, the major portion of the gas injected for pre-quenching purposes comprises recycled petroleum fractions derived from the products of pyrolysis, e.g. in the range C4 to light gas oil, with the recycled fractions preferably being constituted essentially by hydrotreated pyrolysis gasoline.

Thus, by limited and controlled post-cracking of pyrolysis gasoline fractions, an increase in olefin yield is obtained, together with an increase in the octane number of the pyrolysis gasoline which is cracked more severely by virtue of being partially recycled.

For example, the gas used for pre-quenching may be a small fraction of the effluent flow from a first indirect quench, said fraction being recompressed (advantageously by an ejector) and reinjected into the collection zone.

A fraction of the cracked feedstock particularly advantageous for cooling is a feedstock of cracked and cooled ethane (e.g. recycling ethane); when using post-cracking in the transfer line, it is possible to obtain higher conversion of the ethane (e.g. 65%–70%).

The temperature of the effluents leaving the pre-quenching can be regulated by varying the pressure or the flow rate of the pre-quenching gas.

According to yet another major characteristic of the invention, the medium or agent injected into the collection zone for pre-quenching comprises erosive solid particles, which are preferably conveyed by a flow of carrier gas.

For example, these solid particles may have a grain size lying in the range about 5 microns to about 250 microns. E.g. in the range 5 microns to 60 microns at a flow rate lying in the range 0.05% to 8% by weight of the steam cracking effluent flow rate.

The particles serve to decoke the collection zone, the transfer duct, and the quenching heat exchanger by erosion.

Advantageously, the particles are separated from the gaseous effluents at the outlet from the quenching heat exchanger, e.g. in a cyclone, and they are recompressed for recycling by injection into the effluent collection zone at the outlet from the furnace tubes.

The invention also provides an installation for steam cracking hydrocarbons, in particular by performing the method described above, the installation comprising a cracking furnace having small single-pass tubes, and means for quenching the gaseous effluents leaving the furnace, the installation being characterized in that the tubes are connected to one another inside the furnace by an outlet manifold which is connected to the quenching means by a transfer duct, with a compact zone for controlled cooling of the effluents being provided inside the furnace in the immediate vicinity of the outlet ends of the small tubes for the purpose of performing limited pre-quenching of the effluents by not more than 160° C. prior to their transfer to the quenching means.

This compact zone may be constituted by a heat exchanger situated immediately upstream from the outlet manifold, or else by the outlet manifold itself which then includes means for injecting a relatively low flow rate of a gaseous agent or medium at a temperature lower than that of the effluents.

When the final quenching means comprise a heat exchanger, a duct connected to the outlet of said heat exchanger may advantageously be used for taking off a small fraction of the flow of gaseous effluents for the purpose of conveying it to recompression means (e.g. an ejector) connected to injection means in the above-mentioned outlet manifold.

When the pre-quench gas injected into the outlet manifold conveys erosive solid particles, a gas-solid separator such as a cyclone is provided at the outlet from the quenching heat exchanger to separate these solid particles from the flow rate of gaseous effluents. Means are provided for recycling these solid particles through the manifold at the outlet from the furnace tubes.

In general, the invention enables hydrocarbons to be steam cracked in a single-pass furnace having small-diameter tubes which are connected by means of an outlet manifold to a quenching heat exchanger, thereby obtaining a higher yield of olefins, but without running the risk of over cracking the effluents. By using a controlled post-cracking zone, the invention also makes it possible to enlarge the range of feedstocks that may be treated, and in particular to make it possible to use feedstocks that are refractory, such a propane or ethane.

In the following description, given by way of example, reference is made to the accompanying drawings, in which:

FIG. 1 is a diagram of a first embodiment of an installation of the invention; and FIGS. 2 to 6 are diagrams of other embodiments of the installation.

FIG. 1 is a diagram of a hydrocarbon steam cracking furnace 10 including a series of parallel rectilinear tubes 12 which are interconnected at one end by an inlet manifold 14 fed via a duct 16, and at the other end by an outlet manifold 18 housed inside the furnace and connected by a transfer duct 20 to quenching means 22 for quenching the gaseous effluents of steam cracking.

The furnace 10 is of the single-pass type, with the hydrocarbon feedstock flowing once only through the rectilinear tubes 12 between opposite ends of the furnace. The inside diameter of the tubes 12 is relatively small (e.g. 25 mm) and a large number of tubes are provided. This furnace is therefore designed to operate with a relatively high reaction temperature and a very short transit time for the feedstock through the furnace, thereby improving olefin yield in conventional manner.

In accordance with the invention, the outlet manifold 18 has injected therein a preferably gaseous medium or agent at a temperature which is lower than the temperature of the gaseous effluents penetrating into the manifold 18.

This gaseous agent is injected by means of a duct 24 connected to an end 26 of the outlet manifold 18 opposite from the end 28 of the manifold which is connected to the transfer duct 20. Pressure or flow rate adjusting means 30 are provided on the duct 24 and are controlled by means 32 which are responsive to the temperature of the gaseous effluents in the transfer duct 20, thereby making it possible to regulate said temperature by varying the flow rate of the gas injected into the outlet manifold 18.

The temperature difference between the injected gas and the steam cracking effluents serve to perform limited pre-quenching of the effluents within the outlet manifold 18. It will be understood that the pre-quenching gas heats up as it progresses towards the transfer duct 20 and as a result its effect on the effluents is reduced near the outlet from the manifold 18, thus making it possible, if so desired, to perform post-cracking of the effluents in the transfer duct 20 leading to the quenching means 22. This post-cracking may be limited and controlled by the above-mentioned means 30 and 32.

The gaseous effluents in the outlet manifold 18 are cooled by not more than about 160° C., with the effluents having a temperature lying in the range about 780° C. to about 860° C. on leaving the manifold 18. More precisely, the cooling of the gaseous effluents due to pre-quenching is less than 130° C., e.g. lying in the range about 4° C. to about 120° C., and preferably lying in the range 10° C. to 100° C., or better in the range 30° C. to 80° C. The pre-quenching gas conveyed by the duct 24 is preferably constituted, in large part, by recycled petroleum fractions taken from the pyrolysis products, e.g. in the range C4 to light gas oil. It may be essentially constituted by pyrolysis gasoline or by a cooled effluent of steam cracking recycled ethane.

The installation shown in FIG. 1 makes it possible to increase olefin yields by about 6% to about 14% relative to a conventional multi-pass installation.

Figure 2:
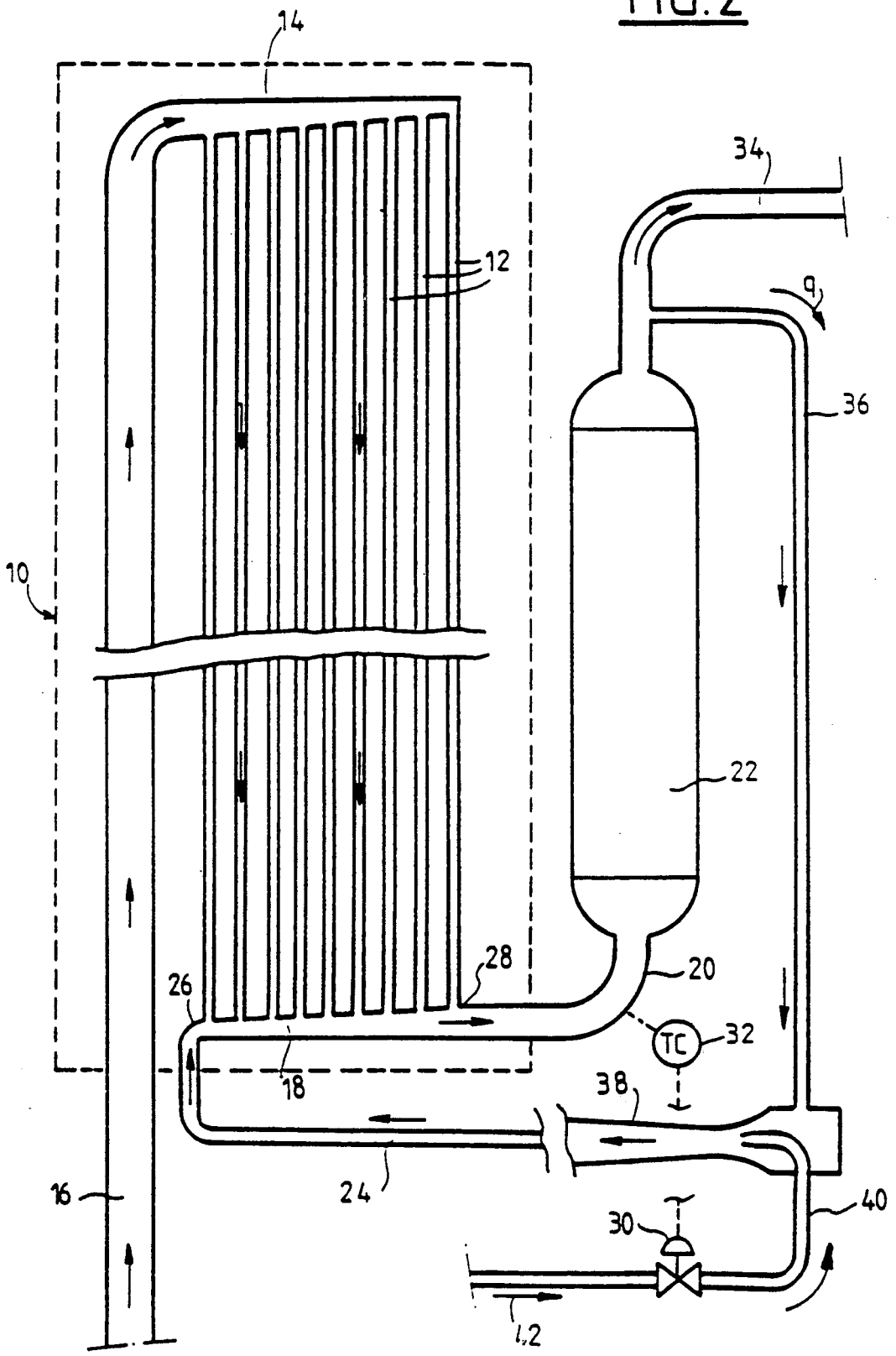

In the variant embodiment shown in FIG. 2, the means for quenching the gaseous steam cracking effluents comprise an indirect quenching heat exchanger, e.g. of the steam boiler type, having its outlet connected by a duct 34 to direct quenching means. A duct 36 connected to the duct 34 serves to take a small fraction q of the gaseous effluent flow rate leaving the quenching heat exchanger 22 and to convey it to recompression means which are constituted in this case by an ejector-compressor 38 driven at 40 by a flow of auxiliary gas 42 at high pressure. The outlet from the ejector-compressor 38 is connected by the duct 24 to the outlet manifold 18 in the furnace 10.

The means 30 and 32 enable the temperature in the transfer duct 20 to be adjusted (e.g. to perform controlled post-cracking), by acting on the flow rate of the driving gas fed to the ejector-compressor 38 via the duct 40.

By recycling a small fraction q of the gaseous effluent flow rate, this variant of the invention serves to limit the amount of auxiliary gas or pre-quenched gas that is consumed.

Figure 3:
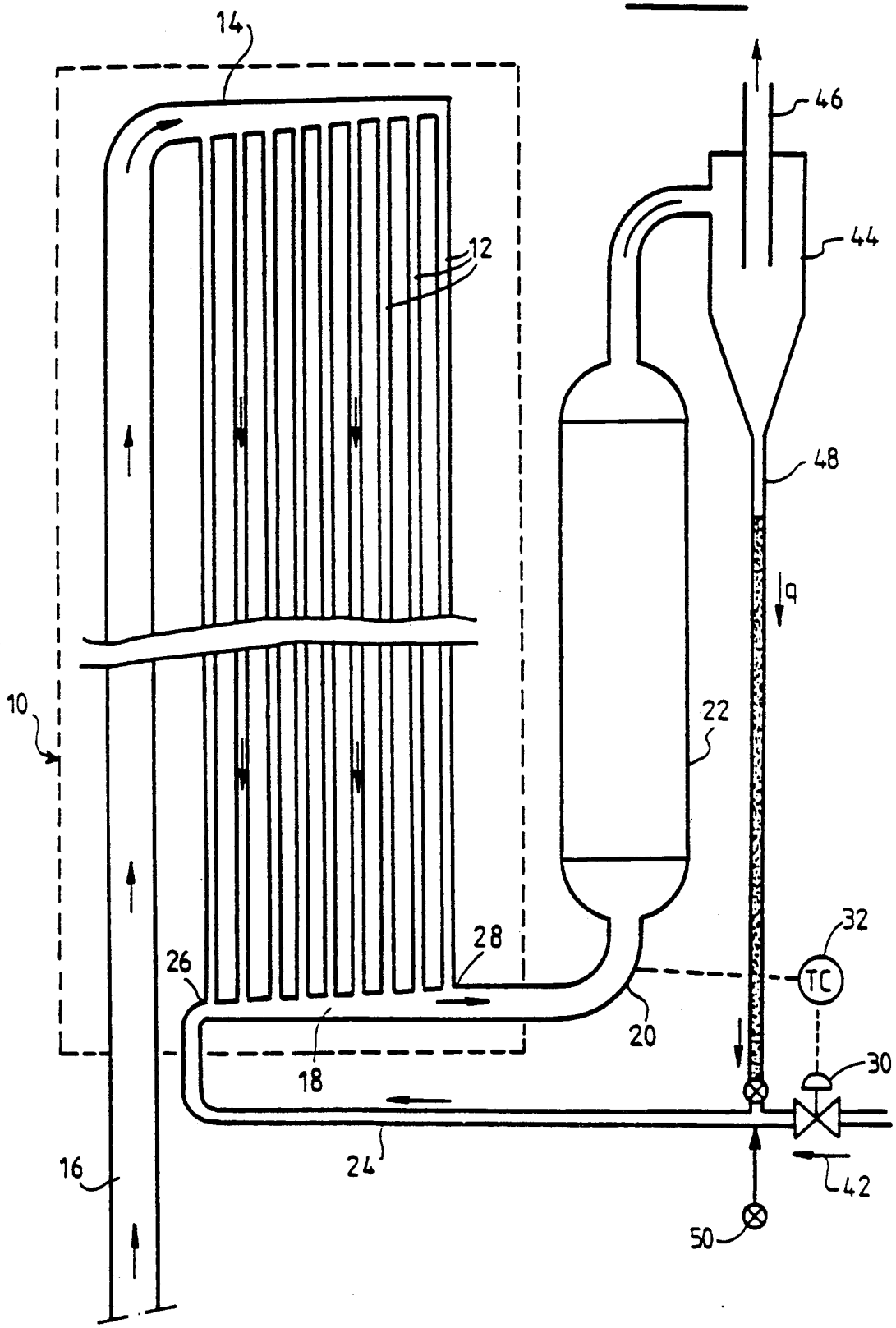

In the variant of FIG. 3, the pre-quenched gas injected into the outlet manifold 18 by the duct 24 contains erosive solid particles of small grain size which serves to decoke the outlet manifold 18, the transfer duct 22, and above all the indirect quenching heat exchanger 22 by erosion.

Gas-solid separator means comprising at least one cyclone 44 are connected in series with the quenching heat exchanger 22. The top of the cyclone 44 includes an outlet duct 46 for gaseous effluents leading to direct quenching means, while the bottom of the cyclone 44 includes a duct 48 for collecting the solid particles separated from the gaseous effluents and also for taking off a small fraction q of the gaseous effluents. A dense phase fluidized bed is thus formed in the vertical duct 48 which enables the pressure of the particles to be raised for reinjection into the duct 24 which is fed with an auxiliary gas flow 42.

As in the preceding embodiment, means 30, 32 are provided for controlling the temperature of the limited pre-quenching. As shown diagrammatically, solid particle topping up means 50 are provided on the injection duct 24 to compensate for inefficiencies in gas-solid separation in the cyclone 44, since a very small quantity of particles may be carried away by the effluents to the final direct quenching means.

The grain size of the solid particles preferably lies in the range about 5 microns to about 250 microns, and these particles are injected into the outlet manifold 18 at a flow rate lying in the range about 0.01% to about 8% by weight of the steam cracking effluent flow rate. It may be observed that the presence of these solid particles in the gaseous effluents conveyed by the transfer duct 20 enhances recombination of free radicals in this zone which improves the yield of the installation.

Figure 4:
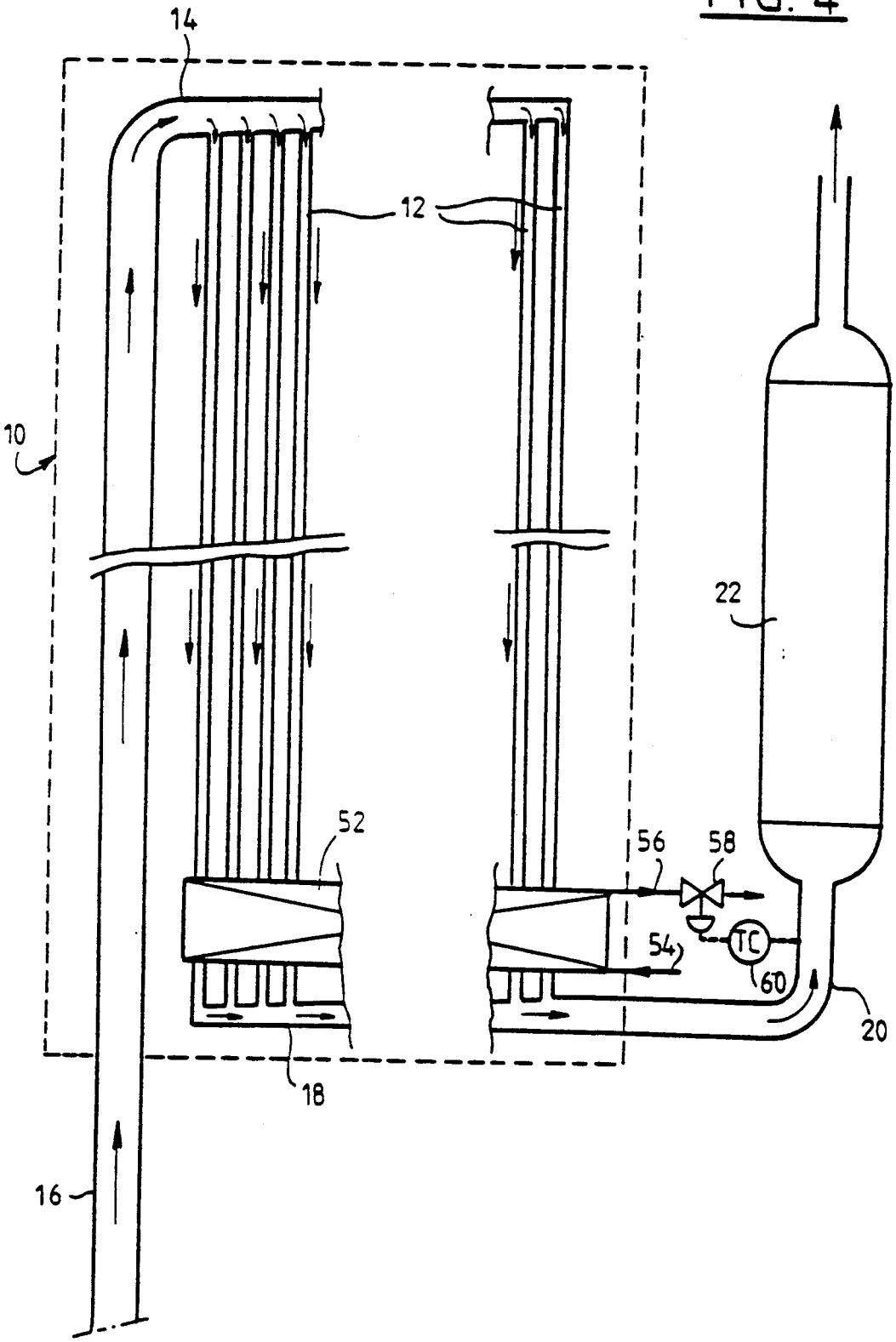

In the embodiment of FIG. 4, the limited pre-quenching of the steam cracking effluent is performed in a compact heat exchanger 52 which is disposed inside the furnace 10 immediately upstream from the outlet manifold 18 and which has the tubes 12 passing therethrough.

This heat exchanger 52 is connected to an inlet duct 54 and to an outlet duct 56 for a fluid which is delivered to the heat exchanger at a temperature that is lower than the temperature of the effluents.

A valve 58 on the outlet duct 56 serves to control the flow rate of the fluid flowing through the heat exchanger 52. This valve 58 may itself be controlled by a device 60 which is responsive to the temperature of the effluents in the transfer duct 20.

The heat exchanger 52 is compact, with the heat exchange length being less than or equal to about one meter, thereby enabling it to be installed without major difficulty in an existing furnace. It is possible to make a heat exchanger which is compact because the pre-quenching of the effluent is very limited and therefore requires only small heat exchange areas.

Figure 5:
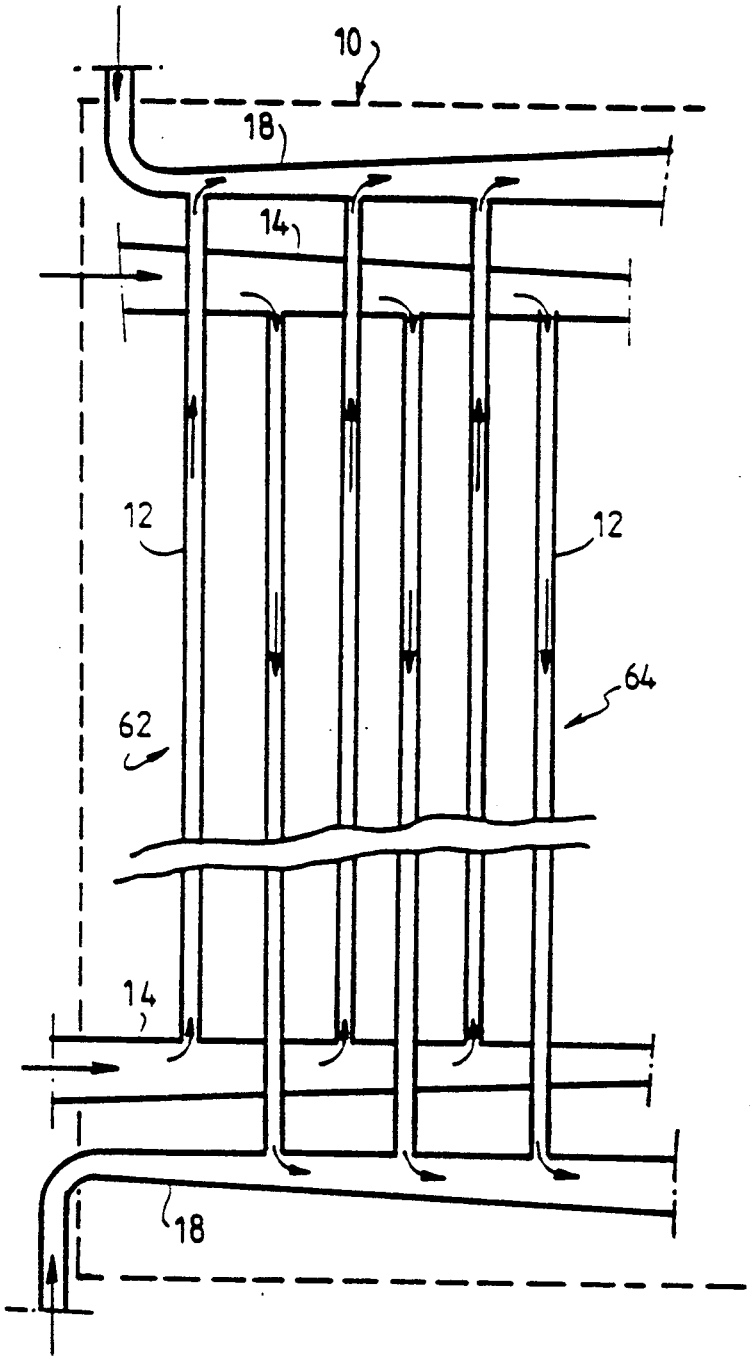

In the embodiment of FIG. 5, the furnace 10 comprises two bundles 62 and 64 of tubes 12 which are intermeshed and which have opposite directions of hydrocarbon flow. Each bundle 62, 64 has its own inlet manifold 14 for one-half of the hydrocarbon feedstock, and its own outlet manifold 18 for steam cracking effluents. The two bundles 62 and 64 are offset vertically a little relative to each other so that the tubes 12 of each bundle pass through the inlet manifold 14 of the other bundle before reaching their own outlet manifold 18.

Each half of the hydrocarbon feedstock fed via one or other of the inlet manifolds 14 to a corresponding bundle of tubes provides limited cooling by heat exchange of the steam cracking effluents flowing along the tubes 12 of the other bundle. Since this cooling remains insufficient, in practice, means for directly injecting a cold fluid into the inlets of the manifolds 18 enable the desired degree of pre-quenching to be obtained.

In addition, and as can be seen in the drawing of FIG. 5, the tubes 12 alternate, one tube belonging to bundle 62 or 64 and then an adjacent tube belonging to the other bundle 64 or 62. Consequently, the end portions of the tubes 12 which are connected to an inlet manifold 14 are considerably colder than the end portions situated at the same level of the tubes in the other bundle which are connected to an outlet manifold 18. They thus pick up more heat energy in the furnace than do the ends of the tubes connected to the outlet manifold. This means that the heat flux in the furnace is picked up preferentially by the portions of the tubes which are connected to an inlet manifold 14, thereby enhancing a rapid rise in temperature for the hydrocarbon feedstock, thus improving yield.

Figure 6:
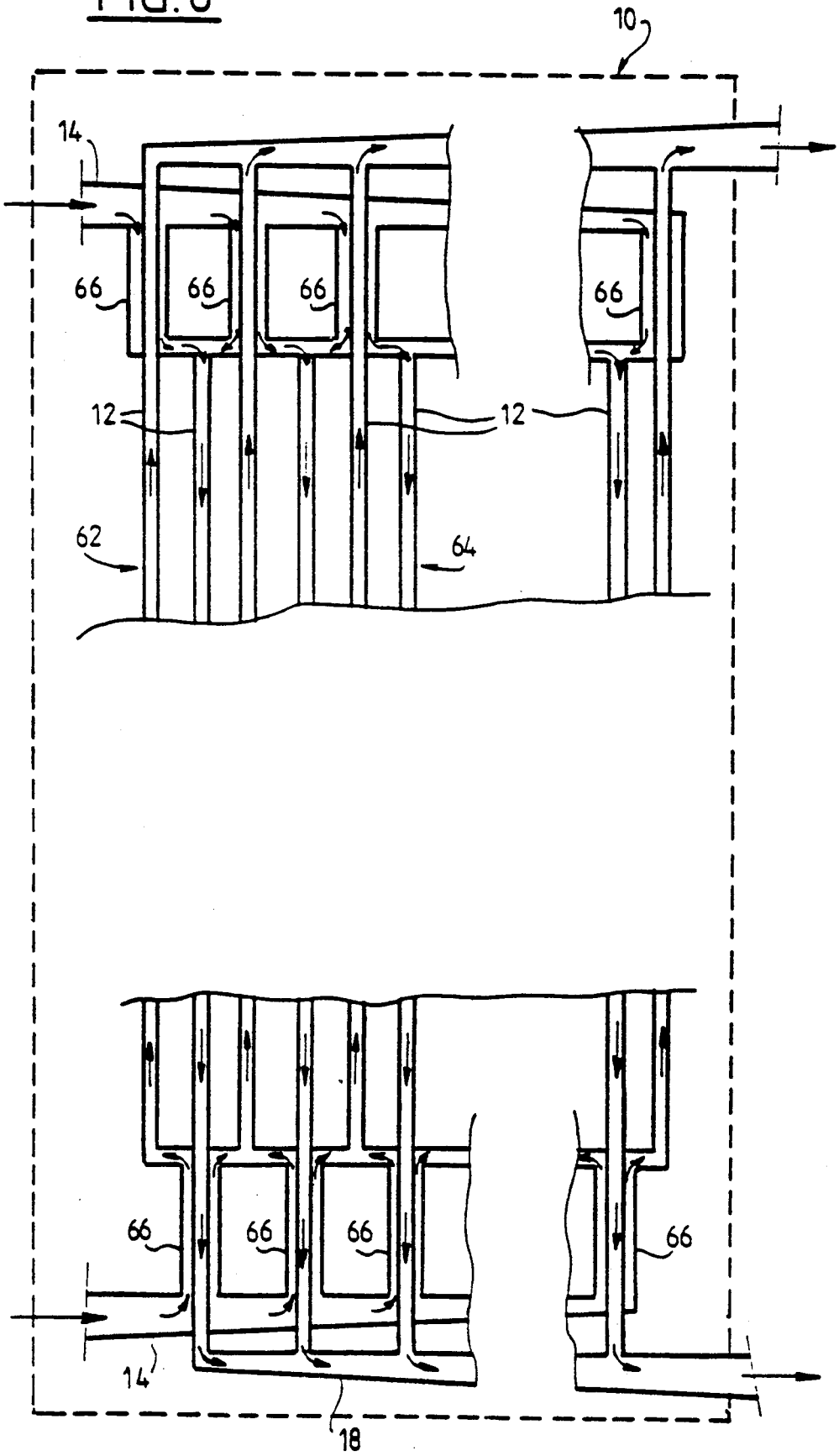

FIG. 6 shows yet another embodiment of the invention, similar to that of FIG. 5, but in which the zone of heat exchange between effluents and one-half of the feedstock entering the furnace is increased. To do this, each inlet manifold 14 is connected to lengths of parallel tubes 66 which are larger in diameter than the tubes 12 and which have the tubes 12 belonging to the other bundle lying on their axes. At their ends furthest from the inlet manifold 14, these lengths of tube 66 are connected to one another and to the tubes 12 belonging to the same bundle as the inlet manifold 14 in question.

These lengths of tube 66 which may be not more than one meter long greatly increase the heat exchange area between each half of the feedstock entering one of the bundles of tubes via its inlet manifold and the ends of the tubes of the other bundle.

The pre-quenching of the steam cracking effluents immediately prior to their entering the outlet manifolds 18 also gives rise to preheating of each of the two halves of the hydrocarbon feedstock.

The invention provides major advantages:

it is possible to use a conventional quenching heat exchanger in conjunction with a single-pass furnace having small diameter tubes;

the limited and controlled pre-quenching of the steam cracking effluents avoids over cracking thereof;

limited and controlled post-cracking of the effluents may take place prior to indirect quenching, thereby making it possible to treat feedstocks that are very light;

the quenching heat exchanger can be decoked by solid particle erosion; and it can be adapted to pre-existing multi-pass installations, thereby increasing ethylene yield by about 10% to 15%, by virtue of single-pass cracking without final over cracking.

I claim:

1. A method of steam cracking hydrocarbons to produce ethylene and other unsaturated low hydrocarbons comprising: causing a feedstock of steam and hydrocarbons to pass at high speed through a furnace having a plurality of single-pass tubes; subjecting the effluents from the tubes to quenching in quenching means outside the furnace, said tubes being connected by an outlet manifold and a transfer duct to the quenching means; cooling said effluents in the outlet manifold, thereby obtaining a limited pre-quenching of the effluents by not more than about 160° C. in the outlet manifold; and performing the pre-quenching of the effluents by injecting a relatively low flow rate of gas at a temperature lower than the temperature of the effluents into the upstream end of said outlet manifold.

2. The method according to claim 1 wherein the pre-quenching is determined so as to enable controlled post-cracking of the effluents to take place in the transfer duct and in the downstream portion of the outlet manifold.

3. The method according to claim 1 wherein the temperature of the effluents at the inlet to said quenching means lies in the range about 780° C. to about 860° C.

4. The method according to claim 1, wherein during said pre-quenching, the temperature of said effluents is lowered from its initial value by an amount between 4° C. and about 130° C.

5. The method according to claim 4, wherein said cooling is lowered from its initial value by an amount between 10° C. and 100° C.

6. The method according to claim 4, wherein said cooling is lowered from its initial value by an amount between 30° C. and 80° C.

7. The method according to claim 1 wherein the major portion of the gas injected into said outlet manifold for pre-quenching comprises recycled petroleum fractions taken from pyrolysis products.

8. The method according to claim 7, wherein said recycled fractions are essentially constituted by pyrolysis gasoline or by a cooled effluent of steam cracking recycled ethane.

9. The method according to claim 1, wherein the gas injected into the outlet manifold includes erosive solid particles having grain size lying in the range about 5 microns to about 250 microns, and wherein the flow rate of solid particles injected into said outlet manifold lies in the range about 0.01% to about 8% by weight of said effluent flow rate.

10. The method according to claim 9, wherein after indirect quenching of the effluents, the solid particles are separated from the steam cracking effluents in a cyclone, the pressure of the recovered particles is increased, and the particles are recycled through said outlet manifold.

11. A method of steam cracking hydrocarbons to produce ethylene and other unsaturated low hydrocarbons comprising: causing a feedstock of steam and hydrocarbons to pass at high speed through a furnace having a plurality of single-pass tubes; subjecting the effluents from the tubes to quenching in quenching means outside said furnace, said tubes being connected by an outlet manifold and a transfer duct to the quenching means; and cooling the effluents in the outlet manifold, thereby obtaining a limited pre-quenching of the effluents by not more than about 160° C. in said outlet manifold whereby said steam cracking comprises splitting said hydrocarbon feedstock into two halves, causing said split feedstock to flow in opposite directions along adjacent tubes, and pre-quenching the outlet effluents of each half of said split feedstock by exchanging heat with the other half being admitted into the furnace.

12. The method according to claim 11, wherein indirect first quenching of the effluents is performed after which a small fraction q of the effluents is taken, recompressed, and injected into said outlet manifold as the pre-quenching gas.

13. The method according to claim 12, wherein the temperature of the effluents leaving said outlet manifold is regulated by varying the flow rate of the pre-quenching gas.

14. An installation for steam cracking hydrocarbons comprising; a cracking furnace having a plurality of single-pass tubes through which a feedstock of hydrocarbons and steam pass at high speed, an outlet manifold connected to said tubes, a transfer duct connecting said outlet manifold to quenching means outside the furnace, means for performing a limited pre-quenching of the effluents by not more than about 160° C. in said outlet manifold, indirect quenching means connected to said transfer duct and a cyclone at the outlet of said indirect quenching means for separating said solid particles from the effluents, wherein said feedstock injected into the outlet manifold comprises erosive solid particles.

15. An installation according to claim 14, wherein said means for performing a limited pre-quenching comprises means for injecting a relatively low flow rate of gas at a temperature lower than the temperature of the effluents into the upstream end of the outlet manifold.

16. An installation according to claim 15, comprising indirect quenching means connected to said transfer duct, a duct connected to the outlet of said indirect quenching means to take off a small fraction of the flow of the effluents, and gas recompression means connecting said duct to the gas injection means to the outlet manifold.

17. An installation according to claim 16, wherein the gas recompression means comprise an ejector-compressor assembly driven by a flow of auxiliary gas at high pressure.

18. An installation for steam cracking hydrocarbons comprising: a cracking furnace having a plurality of single-pass tubes through which a feedstock of hydrocarbons and steam pass at high speed, an outlet manifold connected to said tubes, a transfer duct connecting said outlet manifold to quenching means outside the furnace, and means for performing a limited pre-quenching of the effluents by not more than about 160° C. in said outlet manifold, wherein said cracking furnace comprises two intermeshed bundles or parallel single-pass tubes, the tubes of each bundle being connected at their ends to an inlet manifold and an outlet manifold respectively, the tubes of each bundle passing through the inlet manifold of the other bundle.

* * * * *

UNITED STATES PATENT AND TRADEMARK OFFICE

CERTIFICATE OF CORRECTION

PATENT NO. : 5,139,650

DATED : August 18, 1992

INVENTOR(S) : Eric Lenglet

It is certified that error appears in the above-identified patent and that said Letters Patent is hereby corrected as shown below:

Column 8, line 46, change "cooling" to -- temperature --.

Column 8, line 49, change "cooling" to -- temperature --.

On Title page, item [56], References Cited; FOREIGN PATENT DOCUMENTS the reference identified as "0557089 5/1977 Greece" should read -- 0557089 5/1977 USSR --.

Signed and Sealed this

Twenty-sixth Day of October, 1993

Bruce Lehman

*Attest:*

BRUCE LEHMAN

*Attesting Officer*

*Commissioner of Patents and Trademarks*